United States Patent [19]

Adams et al.

[11] Patent Number: 4,852,811

[45] Date of Patent: Aug. 1, 1989

[54] COMMINUTION OF MATERIAL

[75] Inventors: Roger W. Adams; Hugh R. Falcon-Steward; David A. Pearce, all of St. Austell, United Kingdom

[73] Assignee: E.C.C. International Limited, United Kingdom

[21] Appl. No.: 166,772

[22] Filed: Mar. 4, 1988

Related U.S. Application Data

[63] Continuation of Ser. No. 890,162, Jul. 25, 1986, abandoned.

[30] Foreign Application Priority Data

Aug. 1, 1985 [GB] United Kingdom ..... 8519408

[51] Int. Cl.[4] ..... B02C 13/18; B02C 19/18; B02C 23/24

[52] U.S. Cl. ..... 241/1; 241/3; 241/17; 241/18; 241/22; 241/23; 241/27; 241/29

[58] Field of Search ..... 241/1, 3, 18, 17, 5, 241/39, 41, 42, 27, 22, 23, 29

[56] References Cited

U.S. PATENT DOCUMENTS 3,168,989 2/1965 Heinemann ..... 241/3
3,202,365 8/1965 Barr, Jr. et al. ..... 241/42
3,325,105 6/1967 Veltman .
3,604,634 9/1971 Windle .

FOREIGN PATENT DOCUMENTS 42633 12/1978 Australia .
0094307 9/1987 European Pat. Off. .
1482397 11/1963 Fed. Rep. of Germany .
1319258 6/1973 United Kingdom .
2028785 3/1980 United Kingdom .
2089682 6/1982 United Kingdom .
2106889 4/1983 United Kingdom .
2142840 1/1985 United Kingdom .
2147296 5/1985 United Kingdom .

*Primary Examiner*—Joseph M. Gorski
*Attorney, Agent, or Firm*—Klauber & Jackson

[57] ABSTRACT

Material is comminuted in a substantially dry state in a chamber (4) as a result of agitation by a rotor. During the process, gas is admitted to the chamber (4) through a foraminous base (8) to flow upwardly in a uniform manner across the cross-section of the chamber. Pulses of gas are directed periodically at the material through inlets (15) to prevent agglomeration of the material. The pressure of the gas admitted through the inlets (15) is higher than that admitted through the foraminous base (8). Surface active agents may be added to the material, also to prevent agglomeration, as well as, or instead of the use of pulsed gas.

21 Claims, 2 Drawing Sheets

COMMINUTION OF MATERIAL

This application is a continuation, of application Ser. No. 890,162, filed 7/25/86, now abandoned.

This invention relates to the comminution of material in a substantially dry state, also known as dry grinding.

Our British Patent Specification No. 1,310,222 describes the comminution of a substantially dry material by agitation with a particulate grinding medium in apparatus which comprises a vessel provided with an internal rotor or impeller for agitating the mixture of particulate grinding medium and substantially dry material to be ground. In one embodiment the grinding vessel may be provided with a foraminous base through which an upward flowing current of gas may be passed to carry ground material upwards out of the mixture in the grinding vessel leaving the particulate grinding medium behind.

The mixture in the grinding vessel can be cooled by means of a gas, such as air or carbon dioxide, which is passed into the mixture. Alternatively, the mixture can be cooled by introducing "dry ice" (i.e. carbon dioxide at a temperature below its freezing point), ice or water into the grinding vessel. The problem of agglomeration of finely ground particles is mentioned, but the only solution suggested is the cooling of the mixture in the grinding vessel.

According to one aspect of the present invention there is provided a process for comminuting a material in which the material, in a substantially dry state, is agitated in a grinding chamber, gas being introduced into the grinding chamber at a first pressure to provide an upward flow of gas passing through the agitated material substantially uniformly across the cross-section of the grinding chamber, and pulses of gas at a second pressure higher than the first pressure being directed periodically at the agitated material.

According to a second aspect of the present invention there is provided apparatus for comminuting a material in a substantially dry state, the apparatus comprising a chamber having a foraminous base and a side wall extending upwardly from the base, and means being provided for agitating a material in the chamber, the apparatus further comprising gas supply means for supplying gas to the chamber through the foraminous base at a first pressure to provide an upward flow of gas passing through the agitated material substantially uniformly across the cross-section of the chamber, and pulse means for periodically directing pulses of gas at a second pressure higher than the first pressure at the agitated material.

The material may be comminuted by agitation with a particulate grinding medium which conveniently consists of particles having an average particle size in the range from 150 microns to 10 mm inclusive. The grinding medium advantageously has a Moh hardness of from 5 to 9 and a specific gravity of at least 2.0. However it is also possible to use as the particulate grinding medium beads or granules of a plastics material such as a polyamide or polystyrene. The weight ratio of particulate grinding medium to material to be ground may conveniently be in the range from 2:1 to 10:1.

Alternatively, in certain cases, the substantially dry material may be ground autogenously by impact and abrasion of particles of the material upon one another.

Processes in accordance with the present invention are especially suitable for mineral and inorganic materials such as limestone, marble, chalk, calcined and uncalcined kaolin, mica, talc, wallastonite, magnesite, alumina, gypsum and the like, but may also be used for comminuting organic materials. Limestone, marble and hard chalk can be comminuted effectively by autogenous grinding using the processes in accordance with the present invention.

The gas providing the upward flow is preferably air but in some instances, for example when the material to be ground is inflammable, such as fine coal, it may be desirable to use a gas such as carbon dioxide or nitrogen which does not support combustion. The gas is preferably introduced at a gauge pressure of up to 5 psi (35 KPa) and at a flowrate such as to give an upward current having a velocity in the range from 0.1 to 100 cm/sec. Alternatively the gas may be drawn through the material by reducing the pressure in the grinding chamber above the material.

It is not essential for the perforations in the foraminous base to be uniformly distributed over the entire area of the base. For example, the central area of the base may be continuous, with no perforations, or any perforations in the central region may be blanked off. The object of this is to prevent gas from finding an easy path upwards through the centre of the fluidised bed should a vortex form. Even with such a structure, the upwards flow of gas remains substantially uniform over the cross-section of the chamber.

The purpose of the pulses of gas which are injected into the material is to minimise the formation of aggregates of finely ground particles. These pulses preferably have a duration in the range of from 0.1 seconds to 2 seconds and a frequency of one pulse per 11–120 seconds. The pressure of the injected gas is preferably in the range from 2 psig to 20 psig (14–140 KPa).

Water may be injected into the grinding chamber in order to cool the mixture In one embodiment of a process including this feature, the temperature of the fine particle laden gas leaving the grinding vessel is measured by one or more sensors which control a valve which opens to start water injection into the grinding vessel when the measured temperature exceeds a given maximum value and closes to stop water injection when the measured temperature falls below a given minimum. The maximum temperature is preferably not greater than 140° C. and the minimum temperature is preferably not less than 50° C. The quantity of water supplied in most circumstances is likely to be in the range of from 20 to 150 Kg. of water per tonne of dry ground product. It is found that the product obtained when water is injected into the grinding vessel is generally finer than the product obtained under equivalent conditions but in the absence of water injection. Alternatively, a product of a given particle fineness can be produced at a greater rate with water injection than in the absence of water injection. It is believed that water injection inhibits the formation of agglomerates of finely ground particles and thus helps to preserve a fine state of division in the grinding vessel. Water injection is also important when a bag filter is used to separate the finely divided product from the gas and when the textile material used in the bag filter tends to degrade at temperatures of 100° to 110° C. or above. The amount of water injected must not be so great that the air in the grinding vessel is cooled to the dew point as this would cause severe agglomeration.

According to a third aspect of the present invention there is provided a process for comminuting a material in which the material, in a substantially dry state, is agitated in a grinding chamber, gas being introduced into the grinding chamber at a first pressure to provide an upward flow of gas passing through the agitated material substantially uniformly across the cross-section of the grinding chamber, and pulses of gas at a second pressure higher than the first pressure being directed periodically at the agitated material.

Various surface active agents are suitable for addition to the material to be ground, in order to minimise the formation of aggregates, depending upon the nature of the material and the properties desired for the material after grinding.

For example if the material to be ground is an alkaline earth metal carbonate and the ground material is required to have a hydrophobic surface a suitable surface active agent is a fatty acid having not less than 12 and not more than 20 carbon atoms in the alkyl radical. Stearic acid has been found to be especially suitable. Salts of fatty acids, especially calcium stearate, may also be used.

Cationic surface active agents such as amines comprising at least one alkyl radical having not less than 12 and not more than 20 carbon atoms, and water soluble salts thereof, may also be used. Especially suitable are diamines comprising one alkyl group having not less than 12 and not more than 20 carbon atoms, and acetates thereof. Other suitable surface active agents include substituted organo-alkoxysilanes wherein the organo group is an olefinic radical such as vinyl, allyl or gamma-methacryloxypropyl; an aminoalkyl radical; or a mercaptoalkyl radical. Organo-alkoxysilanes which are especially preferred include vinyl-tris (2 methoxyethoxy) silane, gamma-aminopropyltriethoxysilane and gamma-mercaptopropyltrimethoxysilane.

If the material to be ground is required to have a hydrophilic surface, nonionic and anionic surface active agents are preferred. Amongst suitable nonionic surface active agents are higher alkyl- and alkyl phenyl- ethoxylates. Advantageously the terminal hydroxyl group of the ethoxylate chain is replaced by a hydrophobic radical to reduce foaming in aqueous media. An especially suitable nonionic surface active agent has been found to be octyl phenoxy polyethoxyethyl benzyl ether.

Examples of suitable anionic dispersing agents include phosphate esters which generally include a mixture of compounds of the general formula

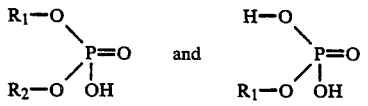

wherein $R_1$ and $R_2$ are the same or different and each comprise an alkyl group, an aryl group, an aralkyl group or an alkaryl group. Preferably $R_1$ and $R_2$ each contain not more than 10 carbon atoms.

Also suitable is a mono- or di- alkali metal or ammonium salt of a copolymer of maleic anhydride and diisobutylene. The copolymer may be partially esterified with an alkyl alcohol, an aralkyl alcohol or a phenol.

A further class of suitable aniomic dispersing agents is that of the sulphosuccinates which can be represented by the general formula:

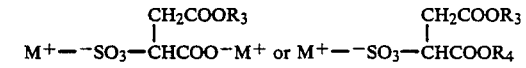

wherein M is an alkali metal or ammonium and $R_3$ and $R_4$ are the same or different and each comprise an alkyl group or an ethoxylate group derived from an alkyl alcohol an alkyl phenol or an alkylolamide. The surface active agent may be an alkali metal or ammonium salt of a copolymer of acrylamide and succinic acid.

The quantity of the dispersing agent used is generally not less than 0.01% and not more than 2% by weight based on the weight of dry material to be ground.

Apparatus in accordance with the second aspect of the present invention preferably comprises a generally cylindrical or prismatic grinding vessel disposed with its longitudinal axis vertical. The foraminous base comprises a partition provided in the vessel to separate the grinding chamber from a plenum chamber. An inlet for gas is provided at or near the bottom of the grinding vessel so as to open into the plenum chamber, and an outlet is provided at or near the top for a mixture of gas and finely ground material. The foraminous partition serves to distribute the flow of gas so as to provide a substantially uniform gas flow velocity across the whole cross-section of the bed of material above the foraminous partition, while preventing the particles of material to be ground, and of particulate grinding medium, if used, from falling into the plenum chamber.

The foraminous partition preferably comprises a metallic mesh material supported on a perforated plate or sandwiched between two perforated plates. The aperture size of the mesh is sufficiently fine so that the finest particles present in the bed do not easily pass through the apertures but yet not so fine that the mesh has insufficient mechanical strength. Preferably the aperture size of the mesh is in the range from 50 microns to 250 microns.

The means for agitating the material may comprise a rotor or impeller mounted on a rotating shaft which may be driven from its upper end and pass downwards through the top of the grinding vessel where suitable bearings are provided. Alternatively the shaft may be driven from its lower end and may pass upwards through rotation-permitting supporting means provided in the bottom of the grinding vessel and in the foraminous partition. The rotor may consist of a plurality of blades or bars extending radially from the shaft, or solid or perforated discs disposed generally in a plane perpendicular to the shaft.

The number of inlets through which gas at high pressure can be injected into the bed of material is conveniently between 2 and 8. The inlets are conveniently linked together by means of a manifold arrangement so that all of the inlets are supplied from a common source of high pressure air.

An inlet above the foraminous partition is provided for introducing material to be ground and optionally a surface active agent, into the grinding vessel. This inlet may be opened and closed by means of a suitable valve, for example a rotary valve or gate valve. A further inlet may be provided for introducing particulate grinding medium into the grinding vessel.

The mixture of gas and finely ground material discharged from the top of the grinding vessel may be passed to means for separating the solid material from the gas, for example a cyclone or bag filter unit.

In the operation of a preferred embodiment of the apparatus, the supply of material to be ground to the grinding vessel is started or stopped in response to the current drawn by the electric motor driving the impeller. A current transformer is used to produce an alternating current in the range 0–5 A which is proportional to the current drawn by the electric motor which is generally in the range 0–400 amps A.C. The current 0–5 amps A.C. is rectified by means of a rectifier bridge to yield a direct current of a few milliamps which is applied to a network of resistors in a two-step controller. The two-step controller energises a relay coil when the potential difference across the network of resistors rises to a given first predetermined level and de-energises the relay coil when the potential difference falls to a given second predetermined level. The relay coil opens and closes contacts which stop and start an electric motor driving conveyor means which supplies material to be ground to the grinding vessel.

An interesting and surprising feature of the process of this invention is that the current drawn by the electric motor driving the impeller is a function of the weight ratio of particulate grinding medium to material to be ground in the grinding vessel and a function of the nature of the material to be ground. This function is non-linear, and so, for example, when the weight ratio of particulate grinding medium to material to be ground is high (above about 2–3 in the case of marble and above about 9 in the case of chalk) the current drawn by the electric motor increases as the weight ratio decreases (i.e. as more material to be ground is fed to the grinding vessel). However at lower weight ratios of particulate grinding medium to material to be ground the current drawn by the electric motor decreases with decreasing weight ratio. In the first case therefore the two-step controller must de-energise the motor driving the feed conveyor means when the impeller motor current rises above the upper predetermined level and re-energise it when the impeller motor current falls below the second predetermined level. In the second case the modes of operation are reversed.

For a better understanding of the present invention and to show how it may be carried into effect, reference will now be made, by way of example, to the accompanying drawings, in which.

Figure 1:
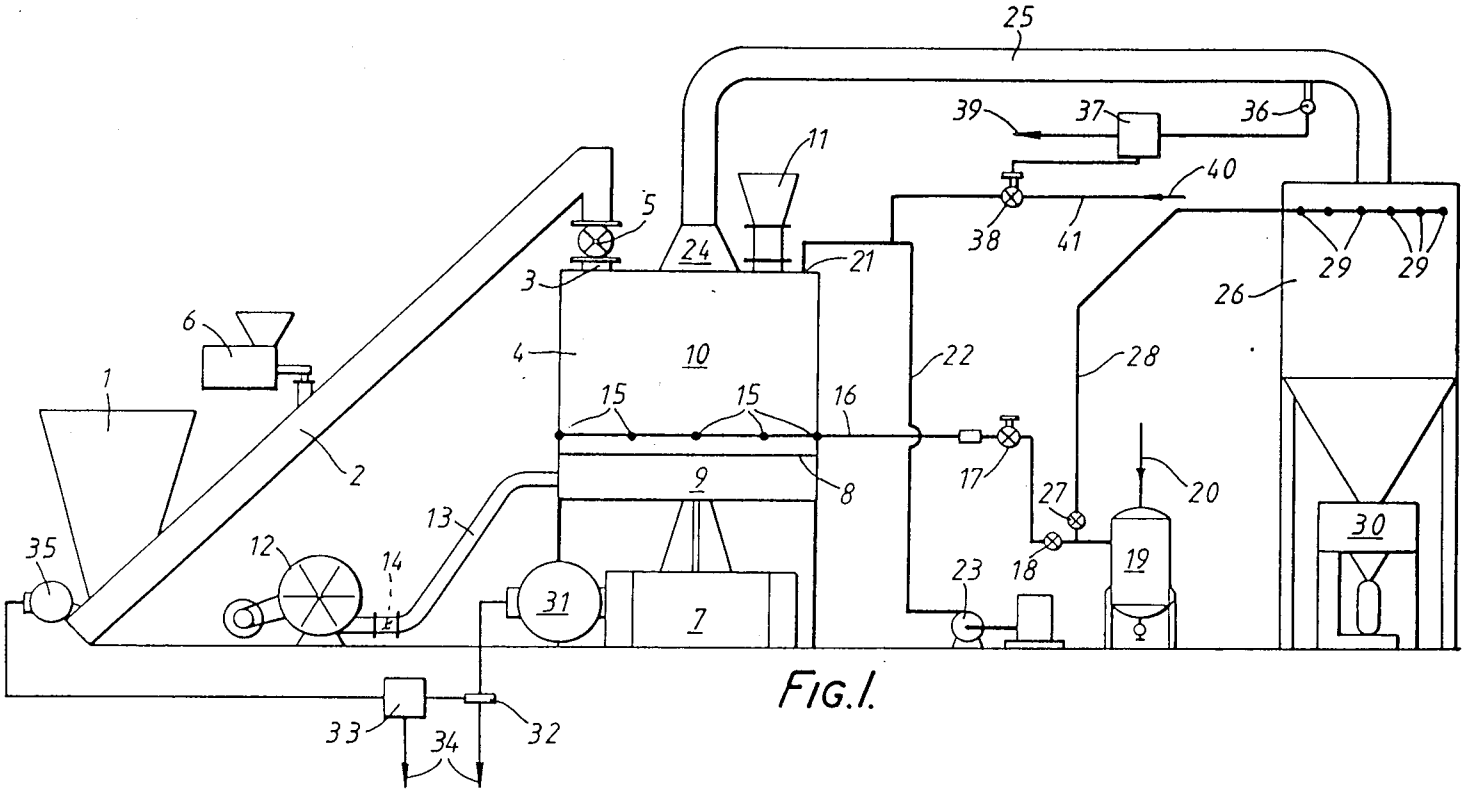
FIG. 1 is a diagrammatic representation of a dry grinding plant.

In the plant shown in FIG. 1, material to be ground is loaded into a feed hopper 1, the base of which discharges into a screw conveyor 2, which is driven by an electric motor 35. The screw conveyor 2 raises the material so that it can fall by gravity through a feed inlet 3 of a grinding vessel 4. The flow of material into the grinding vessel is controlled by a rotary valve 5. Also discharging into the screw conveyor 2 is a feeder 6, for a surface active agent. Inside the grinding vessel 4, a rotating impeller 42 (FIG. 2), is mounted on a vertical shaft 45 driven at its bottom end by an electric motor 31 and gearbox 7. A foraminous partition 8 divides the interior of the grinding vessel into a lower plenum chamber 9 and an upper chamber 10 which contains a mixture of the material to be ground and a particulate grinding material, in the form of a bed supported on the partition 8. Particulate grinding medium is added, when required, through a hopper 11 mounted on the top of the grinding vessel, the bottom of the hopper being closed by a sliding gate.

Air at a gauge pressure of up to 35 KPa is supplied to the plenum chamber through a conduit 13 from a compressor 12. A damper 14 is provided in the conduit to control the flow of air. Around the wall of the grinding vessel just above the foraminous partition is mounted a plurality of inlets 15 (there are eight in the embodiment of FIG. 1, of which only five are visible) for the injection of air at a pressure in the range from 14 KPa to 140 KPa into the bed of material. The inlets 15 are supplied by a common manifold 16 from a compressed air receiver 19, which is connected by a conduit 20 to a source of compressed air at an appropriate pressure. A control device 17 controls the duration and frequency of pulses of the high pressure air, and there is also an on/off valve 18.

Additional surface active agent may be supplied through a conduit 22 and an inlet 21 at the top of the grinding chamber by means of a dosing pump 23. A mixture of air and finely ground particles is discharged from the grinding chamber through an outlet 24 and a conduit 25 to a bag filter assembly 26 where the finely ground material is separated from the air. Pulses of high pressure air are supplied from the receiver 19 through a control device 27, which controls the duration and frequency of the pulses, and a conduit 28, to a plurality of inlets 29 communicating with the interior of filter stockings (not shown) in the bag filter in order to blow accumulated solid material off the outer surface of the filter stockings. The solid material falls to the base of the bag filter assembly whence it is discharged to a bag filling assembly 30.

In operation, the current drawn by the electric motor 31 is monitored by means of a current transformer 32 which produces an alternating current in the range 0 −5A which is proportional to the motor current. This alternating current is applied to a two-step controller 33 in which the alternating current is rectified and the resultant direct current passed through a network of resistors. In accordance with the value of the potential difference across this network of resistors, a relay coil is energised or de-energised to open or close a circuit which supplies electric power to the motor 35 which drives the screw conveyor 2. The controller 33 and the motor 31 are connected to a main electrical switchboard by means of suitable conductors 34.

A temperature measuring device 36, for example a thermocouple, senses the temperature of the fine particle laden gas in the conduit 25. Depending on the e.m.f. produced by the temperature measuring device 36, a relay coil is energised or de-energised to open a solenoid actuated valve 38 when the temperature in the conduit 25 rises above a given upper value and to close the valve 38 when the measured temperature falls below a given lower value. The solenoid valve 38 is connected on one side to a water supply 40 by means of a suitable conduit 41 and on the other side to a T piece provided in the conduit 22 for supplying surface active agent to the grinding vessel. The cooling water and the additional surface agent therefore both enter the grinding vessel through the same inlet 21.

Figure 2:
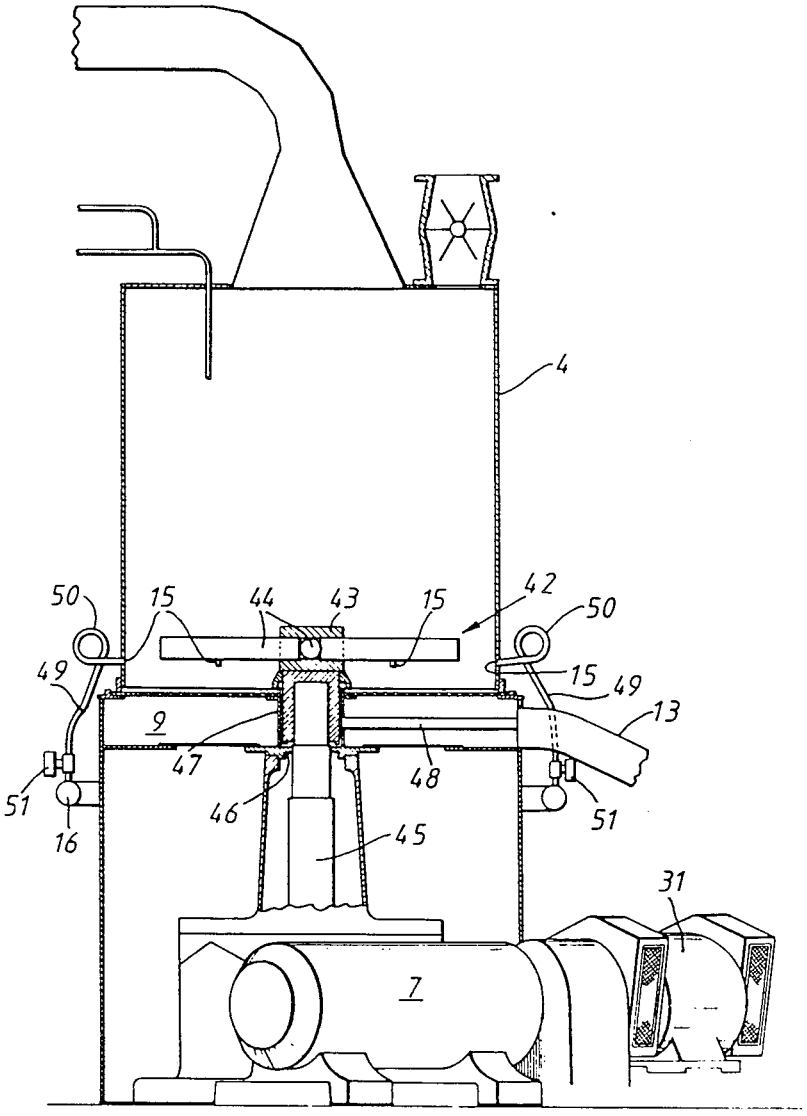
FIG. 2 is a diagrammatic sectional view of the grinding vessel of the plant of FIG. 1.

As shown in FIG. 2, the rotor 42 comprises a boss 43 and four circular section bars 44 which are screwed into the boss 43 and extend radially outwardly in the form of a cross. The rotor 42 is driven by the shaft 45 to which power is transmitted from the electric motor 31 through the gearbox 7. The shaft 45 is supported in a bearing 46 and rotates with some clearance within a sleeve 47, to which clearance gas under pressure is admitted, through a conduit 48, from the stream of gas entering the plenum chamber 9 through the conduit 13.

The inlets 15 for the injection of air at a pressure in the range from 14 KPa to 140 KPa into the grinding vessel are connected to the manifold 16 by eight flexible conduits 49 (only two shown), each flexible conduit having an upwardly extending loop 50. These loops inhibit the passage of solid particles along the flexible conduits and, in any case, any solid particles which enter the inlets 15 are removed by the next pulse of air. Solenoid actuated valves 51 are provided in the conduits 49 to control the timing and duration of the pulses.

The operation of the comminuting apparatus will now be described by reference to the following Examples.

EXAMPLE 1

Talc having a particle size distribution such that 1% by weight consisted of particles having a diameter greater than 53 microns, 57% by weight consisted of particles having an equivalent spherical diameter larger than 10 microns and 12% by weight consisted of particles having an equivalent spherical diameter smaller than 2 microns was comminuted in a dry grinding mill similar to that shown in the FIGURE, but with the rotor or impeller mounted on a rotating shaft which is driven from its upper end and which is supported in bearings provided at the top of the grinding vessel. Three samples of talc were comminuted, and in each case the grinding vessel was charged with 5 kg of silica sand, as grinding medium, consisting of particles of sizes between 0.5 mm and 1.0 mm. A total of 600 g of the talc was added in small discrete amounts throughout the duration of each grinding run. Air was supplied to the plenum chamber 9 at a pressure of 0.9 psi (6.0 KPa) but at a different volumetric flow rate for each sample of talc. In addition pulses of air at a pressure of 5 psi (34.5 KPa) and a duration of 1 second were injected into the bed of sand and talc particles at a frequency of one every 20 seconds through the inlets 15.

In each case the finely ground talc was separated in a bag filter from the mixture of air and fine talc discharged from the outlet 24 and was tested for reflectance to light of wavelengths 457 nm and 570 nm and for specific surface area by the B.E.T. nitrogen adsorption method.

For comparison purposes, three portions of the same talc sample were ground by a conventional wet sand grinding method using the same sand in the same size fraction as the grinding medium. The duration of the grinding operation was different for each of the three samples, so that a different quantity of energy was dissipated in the mixture in the grinding vessel in each case. After grinding in each case a suspension of the fine talc was separated from the sand by sieving and the talc was separated by filtration and dried in an oven at 80° C. The dry talc was tested for reflectance to light of wavelengths 457 nm and 570 nm and for specific surface area by the B.E.T. method.

The results are set for in Table I:

TABLE I

| | Air flowrate (liters/min) | Energy dissipated ($KJ.Kg^{-1}$) | Reflectance to light of wavelength 475 nm | 570 nm | Specific surface area ($m^2g^{-1}$) |
|---|---|---|---|---|---|
| Unground talc | — | — | 79.5 | 80.8 | 1.9 |
| Dry ground talc | 55 | — | 80.4 | 82.1 | 7.2 |
| Dry ground talc | 40 | — | 81.3 | 82.5 | 11.9 |
| Dry ground talc | 70 | — | 81.6 | 82.7 | 12.8 |
| Wet ground talc | — | 264 | 76.2 | 77.7 | 7.0 |
| Wet ground talc | — | 1321 | 72.8 | 74.6 | 12.5 |
| Wet ground talc | — | 2378 | 72.5 | 74.9 | 12.8 |

These results show that, for equivalent increases in specific surface area, talc ground by the dry process with pulsed air shows an increase in reflectance to visible light while talc ground by the conventional wet method shows a decrease in reflectance.

EXAMPLE 2

Chalk having a particle size distribution such that 21% by weight consisted of particles having an equivalent spherical diameter larger than 10 microns and 38% by weight consisted of particles having an equivalent spherical diameter smaller than 2 microns was ground in the same dry grinding mill as was used in Example 1 under the same conditions as were described in Example 1 except that the pressure of the air injected in pulses through the inlets 15 was varied for different samples of the chalk.

For each sample of chalk the rate of production of finely ground chalk was measured and the fine chalk was separated in a bag filter and tested for reflectance to light of wavelengths 457 nm and 570 nm and for specific surface area by the B.E.T method.

The experiment was then repeated but in each case there was added to the chalk 1% by weight, based on the weight of chalk, of stearic acid as a surface active agent. In each case the rate of production, reflectance to visible light and specific surface area were measured as described above.

The results are set forth in Table II:

TABLE II

| | Air pulse pressure (lPa) | Production rate g/hour) | Reflectance to light of wavelength 457 nm | 570 nm | Specific surface area ($m^2g^{-1}$) |
|---|---|---|---|---|---|
| Without stearic acid | 0 | 64.4 | 85.3 | 89.7 | 6.7 |
| | 34.5 | 61.7 | 85.0 | 89.4 | 5.5 |
| | 68.9 | 93.3 | 84.9 | 89.4 | 5.0 |
| | 103.4 | 164.7 | 84.5 | 89.2 | 4.2 |
| With stearic acid | 0 | 301.7 | 84.6 | 88.0 | 7.3 |
| | 34.5 | 396.7 | 84.2 | 87.7 | 6.4 |
| | 68.9 | 488.0 | 83.8 | 87.4 | 5.0 |

TABLE II-continued

| | Air pulse pressure (lPa) | Production rate g/hour) | Reflectance to light of wavelength 457 nm | 570 nm | Specific surface area ($m^2g^{-1}$) |
|---|---|---|---|---|---|
| | 103.4 | 688.7 | 83.3 | 87.2 | 4.9 |
| Feed chalk | — | — | 82.6 | 88.2 | 2.4 |

These results show that the injection of pulses of air into the bed of sand and chalk particles results in an increase in the rate of production of fine chalk which increases as the pressure of the pulsed air increases, but at the expense of a slight drop in brightness and fineness of the ground product. The addition of 1% by weight of stearic acid, based on the weight of dry chalk, results in a still further increase in production rate but at the expense of a further slight decrease in brightness.

EXAMPLE 3

Marble chippings of sizes in the range from 1 mm to 15 mm were charged at the rate of 1620 grams per hour to the same dry grinding mill as was used in Example I with the same characteristics as for Examples 1 and 2. During the grinding process air was supplied to the plenum chamber 9 at a pressure of about 10 kPa and at a flow rate of 300 liters per minute. The marble was ground autogenously and the ground marble was separated in a bag filter from the mixture of air and ground marble discharged through the outlet 24 and tested for reflectance to visible light, specific surface area by the B.E.T. method and particle size parameters. The product was found to have: a reflectance to light of wavelength 457 nm of 93.6 and to light of wavelength 570 nm of 95.1; a specific surface area of 2.0 $m^2g^{-1}$ and a particle size distribution such that 19% by weight consisted of particles having an equivalent spherical diameter larger than 20 microns, 44% by weight consisted of particles having an equivalent spherical diameter larger than 10 microns and 19% by weight consisted of particles having an equivalent spherical diameter smaller than 2 microns.

EXAMPLE 4

Chalk having a particle size distribution such that 10% by weight consisted of particles having an equivalent spherical diameter larger than 10 microns and 45% by weight consisted of particles having an equivalent spherical diameter smaller than 2 microns was fed at the rate of 100 grams per hour to the same dry grinding mill as was used in Example 1, the grinding vessel being charged with 5 Kg of silica sand consisting of particles of sizes between 0.5 mm and 1.0 mm. Air was supplied to the plenum chamber 9 at a volumetric flow rate of 42 liters per minute but no additional pulses of air were used.

Nine experiments were performed in which three different surface active agents, A,B and C were used at rates of 0.03% by weight, 0.2% by weight and 0.5% by weight, respectively, based on the weight of chalk. The chemical nature of the surface active agents was as follows:

A—an alkyl propylene diamine of the general formula:

$$RNH{\cdot}CH_2{\cdot}CH_2CH_2{\cdot}NH_2$$

where R is an alkyl group derived from tallow.

B—a diacetate formed by treating A with acetic acid.

C—stearic acid.

In each case the production rate of finely ground chalk in grams per minute, the percentage reflectance to light of wavelength 457 nm and 570 nm and the percentage by weight of particles having an equivalent spherical diameter smaller than 2 μm were measured and the results are set forth in Table III.

TABLE III

| Surface active agent | % by weight | Production rate (g/hr) | % reflectance to light of wavelength 457 nm | 570 nm | % by weight smaller than 2 μm e.s.d. |
|---|---|---|---|---|---|
| A | 0.03 | 14.3 | — | — | 64 |
| A | 0.2 | 25.0 | 84.1 | 88.5 | 68 |
| A | 0.5 | 70.5 | 83.3 | 87.1 | 53 |
| B | 0.03 | 24.0 | 84.3 | 88.8 | 52 |
| B | 0.2 | 29.0 | 83.9 | 88.4 | 48 |
| B | 0.5 | 76.0 | 84.3 | 88.8 | 52 |
| C | 0.03 | 18.0 | 84.1 | 88.7 | 61 |
| C | 0.2 | 23.7 | 83.9 | 88.5 | 67 |
| C | 0.5 | 43.0 | 84.6 | 88.8 | 65 |

EXAMPLE 5

A sample of mica was ground in the same dry grinding mill as was used in Example 1, 5 Kg of the same silica sand being used as the grinding medium. The mica was fed into the mill at a rate of 605 grams per hour and a product rate of 586.3 grams per hour was achieved when air was supplied to the plenum chamber at a volumetric flow rate of 300 liters per minute. Additional pulses of air at a pressure of 5 psi (34.5 KPa) and a duration of 1 second were injected into the bed of sand and mica particles every 20 seconds through the inlets 15. The reflectance to light of wavelength 457 nm and 570 nm, the specific surface area, and the percentage by weight of particles smaller than 10 μm, 2 μm, and 1 μm, respectively, were measured for the feed and product and the results are set forth in Table IV below:

TABLE IV

| | % reflectance to light of wavelength 457 nm | 570 nm | Specific surface area ($m^2g^{-1}$) | % by weight of particles smaller than: 10 μm | 2 μm | 1 μm |
|---|---|---|---|---|---|---|
| Feed | 67.6 | 77.0 | 9.8 | 66 | 20 | 12 |
| Product | 69.0 | 79.8 | 15.1 | 78 | 32 | 19 |

EXAMPLE 6

Samples of marble chippings similar to those used in Example 3 were charged to a commercial-scale dry grinder and ground autogenously, air being supplied to the plenum chamber 9 at a flow rate of 7500 liters per minute. The ground marble was separated in a bag filter from the mixture of air and ground marble discharged through the outlet 24. Thermostats were provided in the bag filter to give a first signal when the temperature rose above an upper predetermined level and a second signal when the temperature fell below a lower predetermined level. These signals were used to open and close a solenoid operated valve which admitted water to a manifold arrangement provided with a plurality of small apertures mounted high up in the grinding vessel to supply cooling water to the mixture of air and marble chippings in the grinding vessel. It was observed that when cooling water was first injected the temperature continued to rise for a short time and then began to fall. The production rate of ground marble and the amount of energy dissipated per kilogram of dry marble were measured and the ground marble was tested for reflectance to visible light and percentages by weight of particles having an equivalent spherical diameter small than 2 μm. The results are set forth in Table V below:

TABLE V

| | Production rate (Kg/hr) | Energy dissipated ($KJ.Kg^{-1}$) | % reflectance to light of wavelength 457 nm | 570 nm | % by wt. smaller than 2 μm e.s.d. |
|---|---|---|---|---|---|
| No water injection | 38.3 | 2722 | 89.2 | 92.0 | 32 |
| Temp. controlled 75° C.–100° C. | 69.8 | 1480 | 92.8 | 94.5 | 35 |
| Temp. controlled 50° C.–92° C. | 67.3 | 1570 | 92.4 | 94.2 | 40 |

These results show that when water injection is used to control the temperature of the mixture of air and marble in the grinding vessel an equivalent, or slightly superior product is produced, but at a much greater production rate and smaller consumption of energy per unit weight for a given improvement in fineness.

EXAMPLE 7

Marble granules all of which passed through a sieve of aperture 53 microns were supplied to the grinding vessel of a commercial-scale dry grinder which has been charged with a known weight of silica sand of the type described in Example 1. Air under pressure was supplied at the rate of 5000 liters per minute to the plenum chamber 9. The current drawn by the motor driving the impeller of the grinder was measured and the measured value used to start and stop the conveyor 2 which supplied the marble granules to the grinding chamber. Stearic acid was also fed in as a surface active agent by means of the chemical feeder 6 at the rate of 1% m by weight, based on the weight of dry marble.

The controls system could operate in either one of the following two modes:

(A) the feed conveyor is started when the current drawn by the impeller motor rises above an upper limit and is stopped when the current drawn by the impeller motor falls below a lower limit.

(B) the feed conveyor is stopped when the current drawn by the impeller motor rises above the upper limit and is started when the current drawn by the impeller motor falls below a lower limit.

At the completion of each run the weight ratio of grinding sand to marble, the production rate of fine ground marble and the amount of energy dissipated in the air/marble mixture per kilogram of dry marble were measured. The results are set forth in Table VI below.

TABLE VI

| Control System | Initial weight of sand (kg) | Wt. ratio sand/ marble | Product rate (Kg/hr) | Energy dissipated ($KJ.Kg^{-1}$) |
|---|---|---|---|---|
| B | 151 | 5.53 | 37.8 | 1822 |
| B | 139 | 3.68 | 32.8 | 2155 |
| B | 131 | 4.15 | 41.5 | 1726 |
| A | 123 | 2.15 | 61.3 | 858 |
| A | 131 | 2.15 | 60.0 | 870 |

TABLE VI-continued

| Control System | Initial weight of sand (kg) | Wt. ratio sand/ marble | Product rate (Kg/hr) | Energy dissipated ($KJ.Kg^{-1}$) |
|---|---|---|---|---|
| A | 139 | 1.69 | 63.8 | 836 |

These results show that when the weight ratio of sand to marble falls to about 2–3 the mode of the control system must be reversed. Also at lower ratios of sand to marble the production rate of ground marble is increased and the consumption of energy per unit weight of dry marble for a given improvement in fineness is reduced.

We claim:

1. A process for comminuting a material, the process comprising:

(a) feeding the material, in a substantially dry state, into a grinding chamber, (b) agitating the material by means of a rotor disposed in the grinding chamber, thereby comminuting the material with some particles of comminuted material forming agglomerations, (c) introducing a gas into the grinding chamber at a first pressure, thereby providing an upward flow of gas passing through the grinding chamber substantially uniformly across the cross-section of the grinding chamber, and entraining fine particles of the material in said flow of gas, (d) extracting the upward flowing gas and entrained particles from the grinding chamber through an outlet in the upper region of the grinding chamber, and (e) introducing pulses of gas into the grinding chamber at a second pressure higher than the first pressure, directing said pulses of gas at the agitated material, said pulses have a duration of from 0.1 second to 2 seconds and a frequency of one pulse per 1–120 seconds, and contacting the material with said pulses of gas, thereby breaking up said agglomerations.

2. A process as claimed in claim 1 including directing the pulses of gas at the agitated material from a plurality of locations.

3. A process as claimed in claim 1, in which the second pressure is not less than 14 KPa and not more than 140 KPa.

4. A process as claimed in claim 3, in which the second pressure is not less than 35 KPa.

5. A process as claimed in claim 1 including directing the pulses substantially perpendicular to the upward flow of gas.

6. A process as claimed in claim 1, including adding a surface active agent to the material.

7. A process as claimed in claim 1, including forming a bed of agitated material in the grinding chamber and directing the pulses of gas into the bed of agitated material from a plurality of locations.

8. A process for comminuting a material, the process comprising:

(a) providing a mixture of the material, in a substantially dry state, and a surface active agent in a grinding chamber;

(b) agitiating the mixture by means of a rotor disposed in the grinding chamber, thereby communinuting the material with some particles of comminuted material forming agglomerations;

(c) introducing a gas into the grinding chamber at first pressure, thereby providing an upward flow of gas passing through the grinding chamber substantially uniformly across the cross-section of the grinding chamber, and entraining fine particles of the material in said flow of gas;

(d) extracting the upward flowing gas and entrained particles from the grinding chamber through an outlet in the upper region of the grinding chamber; and (e) introducing pulses of gas into the grinding chamber at a second pressure higher than the first pressure, directing said pulses of gas at the agitated material, said pulses having duration of from 0.1 second to 2 seconds and a frequency of one pulse per 1–120 seconds, and contacting the material with said pulses of gas, thereby breaking up said agglomerations.

9. A process as claimed in claim 8, in which the surface active agent is selected from the group consisting of alkyl fatty acids having not less than 12 and not more than 20 carbon atoms in the alkyl radical and salts thereof.

10. A process as claimed in claim 8, in which the surface active agent is selected from the group consisting of alkyl amines having at least one alkyl radical which has not less than 12 and not more than 20 carbon atoms and salts thereof.

11. A process as claimed in claim 8, in which the surface active agent is selected from the group consisting of: (i) higher alkyl alkoxylates; (ii) alkyl aryl alkoxylates; (iii) higher alkyl alkoxylate in which the terminal hydroxyl group of the alkoxylate chain is replaced by a hydrophobic radical; and (iv) alkyl aryl alkoxylates in which the terminal hydroxyl group of the alkoxylate chain is replaced by a hydrophobic radical.

12. A process as claimed in claim 8, in which the surface active agent is a phosphate ester.

13. A process as claimed in claim 8, in which the surface active agent is selected from the group consisting of mono-alkali metal salts of a copolymer of maleic anhydride and di-isobutylene and di-alkali metal salts of a copolymer of maleic anhydride and di-isobutylene and ammonium salts of a copolymer of maleic anhydride and di-isobutylene.

14. A process as claimed in claim 8, in which the surface active agent is selected from the group consisting of sulphosuccinates which are represented by the general formula:

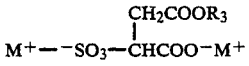

and sulphosuccinates which are represented by the general formula:

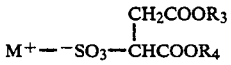

wherein M is selected from the group consisting of alkali metals and ammonium and $R_3$ and $R_4$ each independently represent a group selected from the group consisting of alkyl groups and ethoxylate groups derived from a compound selected from the group consisting of alkyl alcohols, alkyl phenols and alkylolamides.

15. A process as claimed in claim 8, in which the surface active agent is selected from the group consisting of alkali metal salts of a copolymer of acrylamide and succinic acid and ammonium salts of a copolymer of acrylamide and succinic acid.

16. A process as claimed in claim 8, in which the proportion of the surface active agent to the dry material is not less than 0.01% and not more than 2% by 17. A process as claimed in claim 1 or 8, including driving the rotor by an electric motor, and controlling introduction to the grinding chamber of material to be comminuted in response to the current drawn by the electric motor.

18. A process as claimed in claim 1 or 8, including introducing coolant into the grinding chamber in response to an increase above a first predetermined level of the temperature of gas leaving the grinding chamber, and including terminating the introduction of coolant upon a decrease of the temperature below a predetermined second level.

19. A process as claimed in claim 18, in which the predetermined first level is higher than the predetermined second level.

20. A process as claimed in claim 18, in which the predetermined first level is not greater than 140° C.

21. A process as claimed in claim 1 or 8, including generating the upward flow of gas by reducing the pressure in the grinding chamber above the material.

* * * * *